US005540271A

United States Patent [19]

Cook

[11] Patent Number: 5,540,271

[45] Date of Patent: Jul. 30, 1996

[54] LOW VAPOR POINT MATERIAL CASTING APPARATUS AND METHOD

[75] Inventor: Arnold J. Cook, Mt. Pleasant, Pa.

[73] Assignee: PCC Composites, Inc., Pittsburgh, Pa.

[21] Appl. No.: 114,734

[22] Filed: Aug. 30, 1993

Related U.S. Application Data

[63] Continuation-in-part of Ser. No. 871,532, Apr. 21, 1992, Pat. No. 5,275,226, which is a continuation of Ser. No. 607,847, Nov. 1, 1990, Pat. No. 5,111,871, which is a continuation of Ser. No. 325,221, Mar. 17, 1989, abandoned.

[51] Int. Cl.[6] ..... B22D 18/00; B22D 19/14

[52] U.S. Cl. ..... 164/61; 164/66.1; 164/97; 164/119; 164/122.1; 164/254; 164/284

[58] Field of Search ..... 164/61, 63, 66.1, 164/119, 254, 306, 284, 97, 122.1

[56] References Cited

U.S. PATENT DOCUMENTS 5,042,561 8/1991 Chandley ..... 164/66.1 X
5,111,871 5/1992 Cook ..... 164/63
5,224,031 9/1993 Cook et al. ..... 164/119
5,348,071 9/1994 Cook ..... 164/61

*Primary Examiner*—J. Reed Batten, Jr.
*Attorney, Agent, or Firm*—Ansel M. Schwartz

[57] ABSTRACT

The apparatus comprises a vessel having an interior. A mold is disposed within the interior of the vessel. A casting material is contained in the interior of the vessel. The apparatus also comprises a mechanism for providing the casting material to the mold in a manner such that vapors of the casting material are prevented from communicating with the interior of the vessel. The providing mechanism is in communication with the vessel. The providing mechanism comprises an inner chamber within which the mold and casting material are contained in. The providing mechanism further comprises a mechanism for heating the inner chamber, such as heating coils. The heating mechanism is disposed within the interior of the vessel adjacent to the inner chamber. Preferably, the inner chamber has a tube extending therefrom having a filter element, disposed therein for catching vapors of the casting material. Preferably, the tube extends through the vessel such that the interior of the vessel and the inside of the inner chamber are fluidically isolated from each other.

27 Claims, 5 Drawing Sheets

LOW VAPOR POINT MATERIAL CASTING APPARATUS AND METHOD

This is a continuation-in-part application of U.S. patent application Ser. No. 07/871,532 filed Apr. 21, 1992, which issued Jan. 4, 1994, as U.S. Pat. No. 5,275,226, which was a continuation application of U.S. patent application Ser. No. 07/607,847 filed Nov. 1, 1990, which issued May 12, 1992, as U.S. Pat. No. 5,111,871, which was a continuation application of U.S. patent application Ser. No. 07/325,221 filed Mar. 17, 1989, now abandoned.

FIELD OF THE INVENTION

The present invention relates to casting. More specifically, the present invention relates to casting materials such as low vapor point materials, and the creation of net shape components from these materials.

BACKGROUND OF THE INVENTION

Low vapor point metals, such as magnesium, are desirable for use as a cast component because of their low density and other properties. However, production of components, especially metal matrix composites, with low vapor point metals is very difficult. This is because the vacuum required to remove trapped gases from the melt material, mold and reinforcement causes the low vapor point metal to vaporize, become deposited, in lower temperature areas in the casting setup. This makes low vapor point metals very difficult to work with in a normal casting environment, or in Bottom Fill Casting or Top Fill Casting as described in U.S. Pat. Nos. 5,111,871 and 5,111,870, respectively (both of which are incorporated by reference). If a low vapor point metal, such as magnesium is used in these casting operations, which require a vacuum prior to infiltration of liquid metal into the mold, the magnesium tends to be deposited in different areas of the casting inner chamber. Magnesium is also very difficult to work with in non-enclosed casting operations because the material will easily burn with small concentrations of oxygen or other gases.

In production methods of low vapor point metals which do not utilize a vacuum, such as powder metallurgy processes, oxides are trapped or produced within the casting, such as oxides which might exist on the metal powders or the surface of the mold being infiltrated or cast into. Oxides within the casting reduce the strength of the casting and may make secondary operations such as extrusion, stamping, and other secondary operations difficult or impossible.

The present invention resolves these problems of oxide entrapment, depositing of metal, damage and safety problems normally associated with low vapor point metal casting.

The present invention discloses an apparatus and method for production of low vapor point metal components which prevents the metal from being deposited during the casting, and makes it possible to use a vacuum on both the mold and the reinforcement which may be contained in the mold. This makes it possible to efficiently produce components made of low vapor point metal without trapped gas or oxides.

SUMMARY OF THE INVENTION

The present invention pertains to an apparatus for producing low vapor point metal components and low vapor point metal matrix composites. The apparatus comprises a vessel having an interior. There is a mold disposed within the interior of the vessel. There is a casting material contained in the interior of the vessel. The apparatus also comprises means for providing the casting material to the mold in a manner such that vapors of the casting material are prevented from communicating with the interior of the vessel. The providing means is in communication with the vessel.

In a preferred embodiment, magnesium, or other low vapor point metal, such as zinc alloy, is cast in a dual inner chamber casting setup which allows a vacuum to exist within the mold and melt prior to casting or infiltration while preventing deposition of the metal inside the casting inner chamber. The present invention preferably uses a form of Top Fill Casting as described in U.S. Pat. No. 5,111,871, although a Bottom Fill Casting, as described in U.S. Pat. No. 5,111,870 can be used. It should be appreciated that the present invention is not limited to metal but can be applied equally well to any material that has a problem causing vapor point.

In a preferred embodiment, a mold and melt material are contained inside an inner chamber. The mold may contain a reinforcement to be infiltrated, on top of the mold may be placed a filter, on top of the filter may be placed the low vapor point casting material. The inner chamber can be a thin walled inner chamber, such as a tube or can. Preferably, the top of the inner chamber is closed off such that a small diameter tube comes off the inner chamber above the metal. The complete inner chamber is placed within another vessel, such as that described in U.S. Pat. No. 5,111,871. The vessel contains heating elements and may be pressurized. Preferably, the tube from the inner chamber goes through a cooling section and sealing section to the outside of the vessel. The tube outside the inner chamber is connected to vacuum and a pressurizing means. The vessel is also connected to a vacuum and pressurized gas source. For most applications, this gas will be inert, such as argon or nitrogen, however, other gas may be used. Vacuum may be used, but it is not required on either inner chamber for the operation of the invention, however, vacuum is most useful within the inner chamber.

The present invention is also a method of casting low vapor point materials. The method comprises the step of disposing a inner chamber having a mold and casting material within a vessel having an interior. Then, there is the step of introducing the casting material into the mold in a manner such that vapors of the casting material are preventing from communicating with the interior of the vessel. Preferably, before the introducing step, there is the step of heating the inner chamber with heating means disposed within the vessel such that the casting material is melted and stays melted as it is introduced into the mold. Preferably, before the heating step, there is the step of evacuating the vessel and the inner chamber. Preferably, the introducing step includes the step of pressurizing the vessel and the inner chamber such that the material is forced into the mold.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
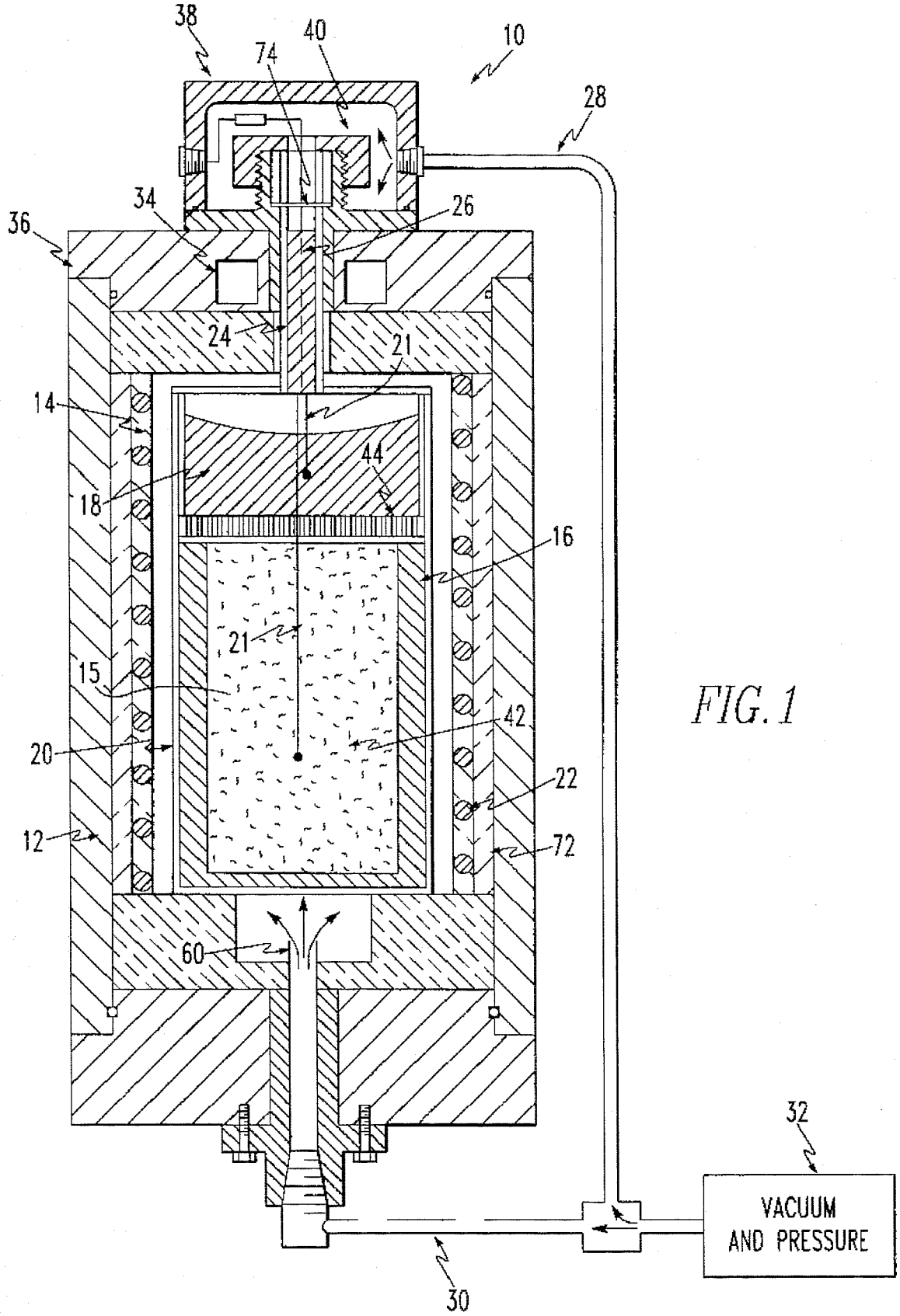
FIG. 1 is a schematic representation showing a cross section of the casting apparatus of the present invention.

Referring now to the drawings wherein like reference numerals refer to similar or identical parts throughout the several views, and more specifically to FIG. 1 thereof, there is shown an apparatus 10 for casting materials, such as low vapor point materials 18. The apparatus comprises a vessel 12 having an interior 14. There is a mold 16 disposed within the interior 14 of the vessel 12. There is a casting material 18 contained in the interior 14 of the vessel 12. The apparatus 10 also comprises means for providing the casting material 18 to the mold 16 in a manner such that vapors of the casting material 18 are prevented from communicating with the interior of the vessel 12. The providing means is in communication with the vessel 12.

In a preferred embodiment, the providing means comprises a inner chamber 20 within which the mold 16 and casting material 18 are contained. The providing means further comprises means for heating the inner chamber 20, such as heating coils 22. The heating means is disposed within the interior 14 of the vessel 12 adjacent to the inner chamber 20.

Preferably, the inner chamber 20 has a tube 24 extending therefrom having a filter element 26, such as 100 pores per inch (ppi) graphite or carbon foam block, or alumina fibers, disposed therein for catching vapors of the casting material 18. Preferably, the tube 24 extends through the vessel 12 such that the interior 14 of the vessel 12 and the inside of the inner chamber 20 are fluidically isolated from each other. Thermocouples 21 can extend through the tube 24 to monitor the temperature of the casting material 18 and the inside of the mold 16.

The providing means can include means 28 for pressurizing and evacuating the inner chamber 20 through the tube 24. The providing means can also comprise means 30 for pressurizing and evacuating the vessel 12. The pressurizing and evacuating means 28, 30 of both the inner chamber 20 and the vessel 12 can be commonly connected to a vacuum and pressure source 32, as shown in FIG. 1.

The vessel 12 preferably has a cooling section 34 disposed adjacent to the tube 24 for condensing any casting material vapors in the tube 24. The cooling section 34 is preferably a cavity disposed in the head 36 of the pressure vessel 12 adjacent to the tube 24 through which water is circulated through. The vessel 12 can include a cap 38 forming a sealed cavity 40 into which the tube 24 of the inner chamber 20 extends into. The inner chamber vacuum and pressurizing means 28 is connected to the cap 38 in fluidic communication with the tube 24. Preferably, the inner chamber 20 has a mold 16 with reinforcement 42 within and a filter 44, such as alumina fibers, between the mold 16 and the casting material 18. Fibers may be pressed into a plug on top of the mold 16 tight against the mold wall. The plug will then prevent molten material 18 from passing through until pressure is applied.

Figure 2:
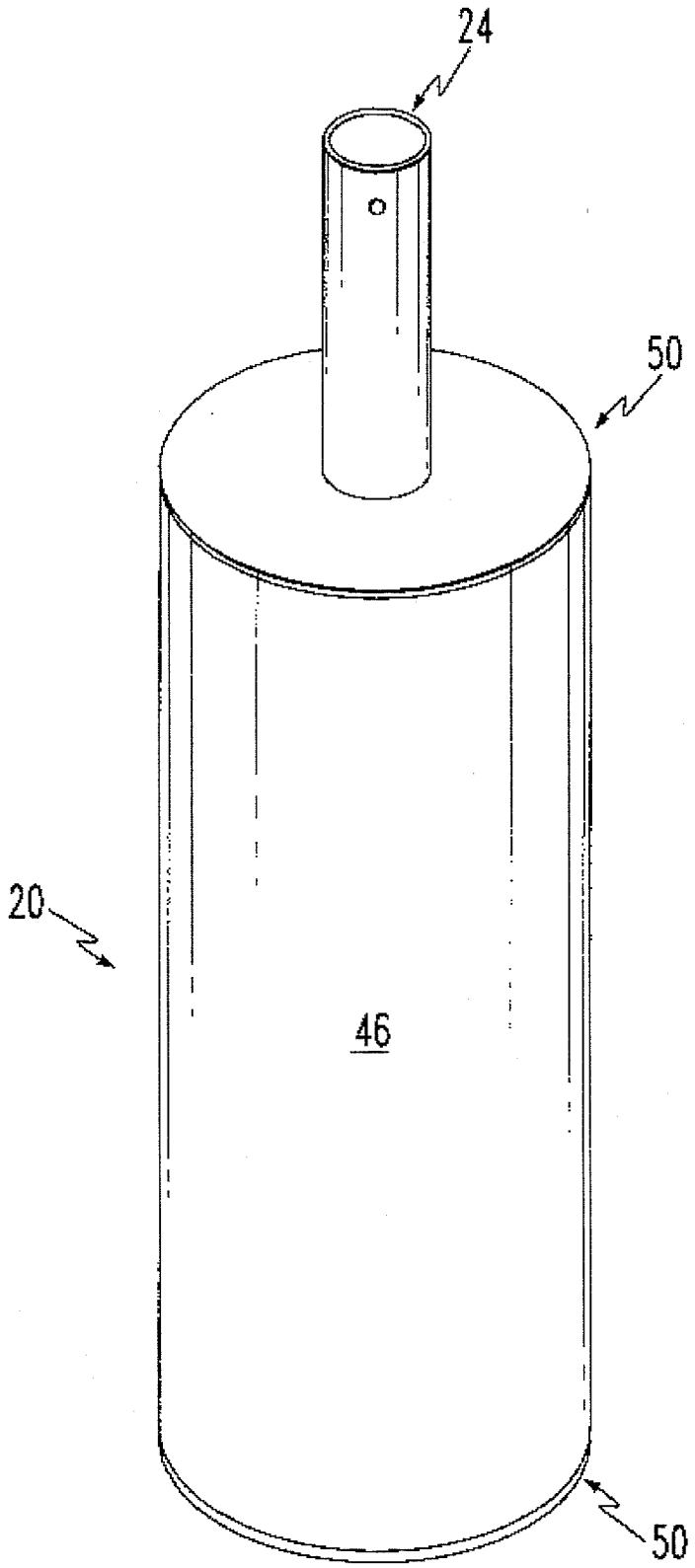
FIG. 2 is a schematic representation showing the inner chamber.

In one embodiment, and as shown in FIG. 2, the inner chamber 20 is comprised of a disposable container 46, such as a stainless steel can, having welded ends 50.

Figure 3A:
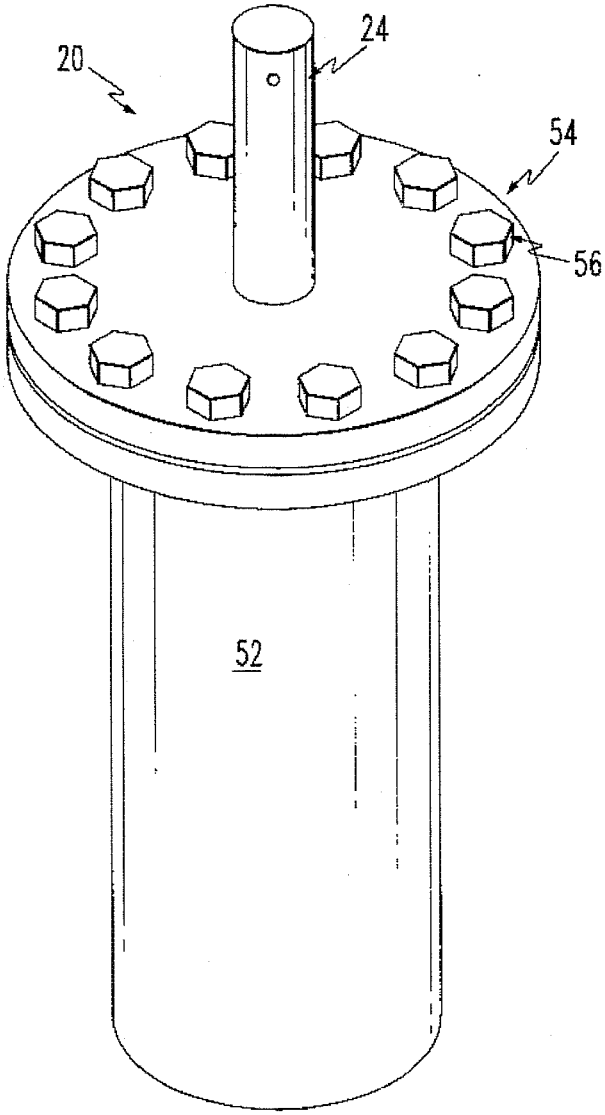
FIGS. 3*a* and 3*b* are schematic representations showing different embodiments of the inner chamber.

Alternatively, as shown in FIG. 3*a*, the inner chamber 20 is comprised of a permanent container 52 having a removable and resealable end 54. Preferably, the container 52 is stainless steel and is bolted to the end 54 with bolts 56. A Grafoil® seal 59 can be used between the container 52 and end 54 for providing a gas tight seal.

Figure 3B:
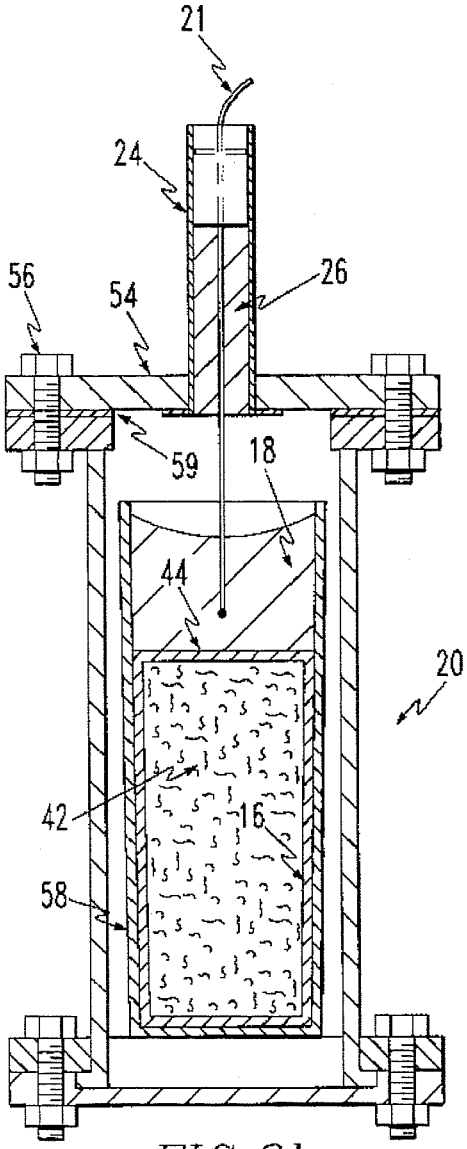

If desired, as shown in FIG. 3*b*, there can be an inner container 58 disposed within the inner chamber 20. The inner container 58 has the mold 16 and casting material 18.

Preferably, the apparatus also comprises means for directionally solidifying the material 18 within the mold 16, as shown in FIG. 1. For instance, the directional solidification means can comprise a gas chill line 60 disposed adjacent to the inner chamber 20 such that gas from the gas chill line 60 is directed against the inner chamber 20. Preferably, the gas chill line 60 is in fluidic communication with the means 30 for pressurizing and evacuating the vessel.

Figure 4A:
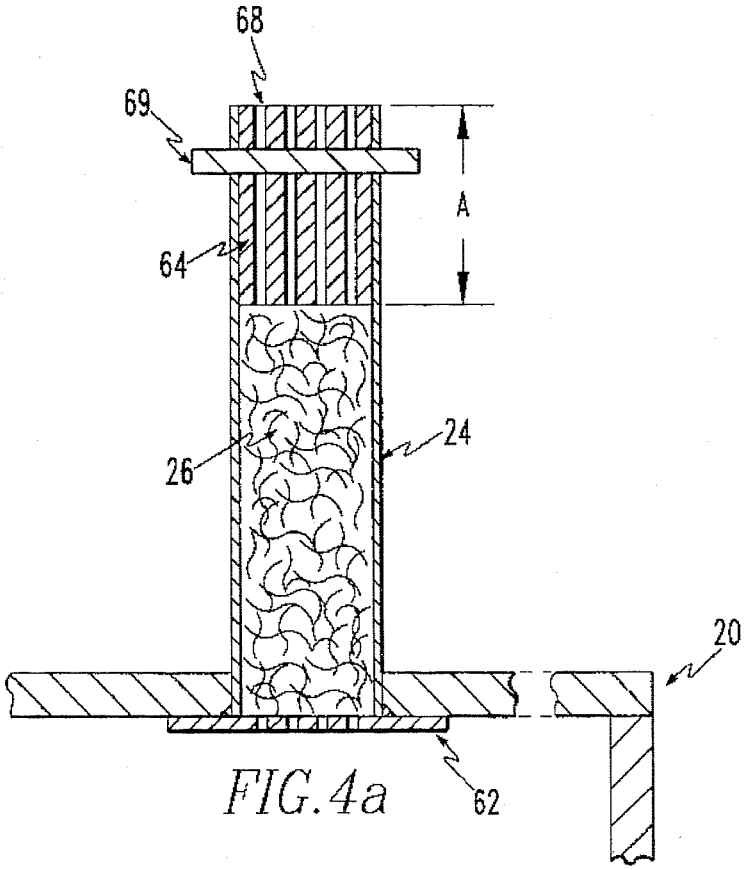
FIGS. 4*a* and 4*b* are schematic representations showing the inside of the tube.
Figure 4B:
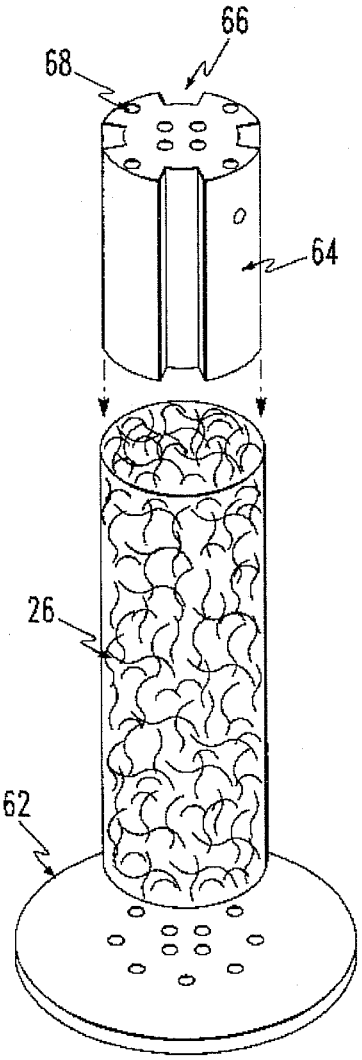

FIGS. 4*a* and 4*b* show a preferred construction of the inside of the tube 24. The element 26 for catching vapors can be a carbon foam block or loose Saffil® fibers. A steel plate 62 with holes can be used to hold the loose Saffil® fibers in the tube 24. Above the vapor catching element 26 is a plug 64, such as brass, with slots 66 for thermocouple wires and holes 68 to pull vacuum and pressure through. A pin 69 can be used to secure the plug 64 in the tube 24.

Figure 5:
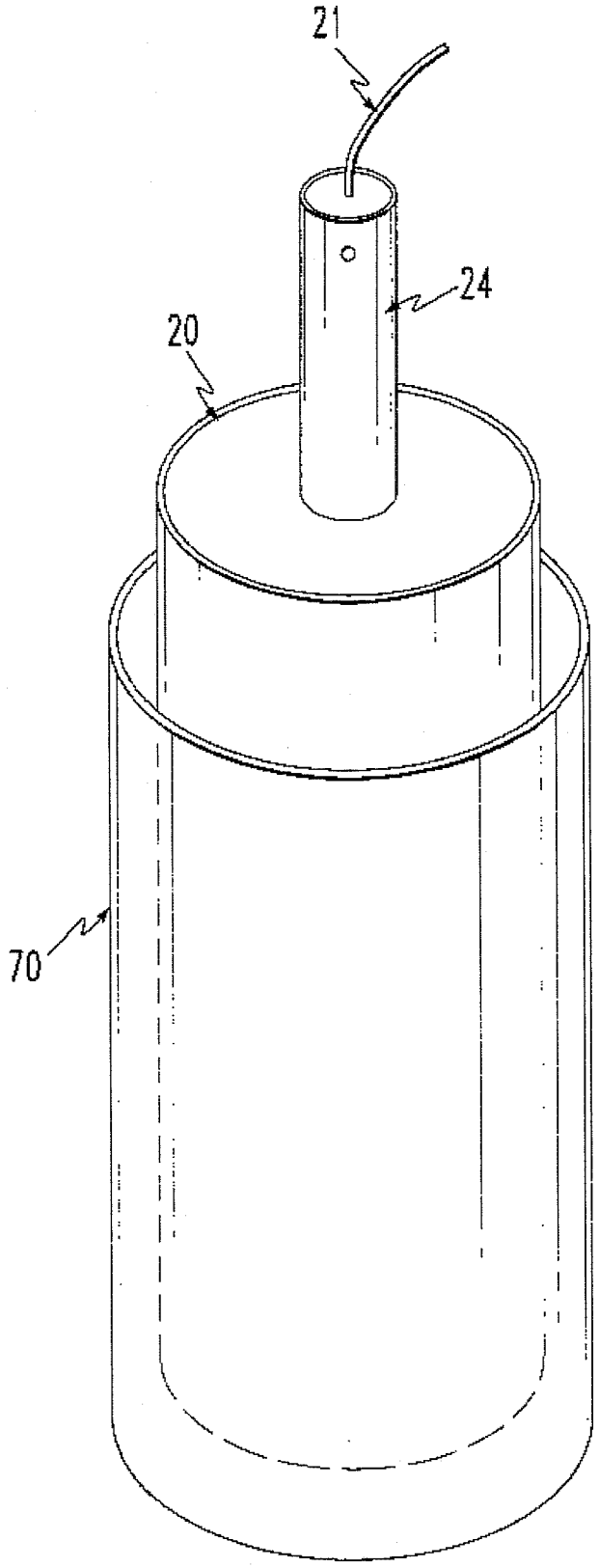
FIG. 5 is a schematic representation of a protection can around the inner chamber.

If desired, as shown in FIG. 5, a protection can 70 can be placed around the inner chamber 20 in the vessel 12 in case of problems, such as metal leakage.

The present invention is also a method of casting low vapor point materials 18. The method comprises the step of disposing an inner chamber 20 having a mold 16 and casting material 18 within a vessel 12 having an interior 14. Then, there is the step of introducing the casting material 18 into the mold 16 in a manner such that vapors of the casting material 18 are preventing from communicating with the interior 14 of the vessel 12. Preferably, before the introducing step, there is the step of heating the inner chamber 20 with heating means 22 disposed within the vessel 12 such that the casting material 18 is melted and stays melted as it is introduced into the mold 16. Preferably, before the heating step, there is the step of evacuating the vessel 12 and the inner chamber 20. Preferably, the introducing step includes the step of pressurizing the vessel and the inner chamber 20 such that the material 18 is forced into the mold 16.

If desired, the introducing step can include the step of directionally solidifying the material 18 within the mold 16. Preferably, the disposing step includes the step of orienting an element 26 within a tube 24 extending from the inner chamber 20 such that the element 26 traps any vapors of the casting material 18. Preferably, the providing step includes the step of cooling the tube 24 to condense any vapors of the casting material 18 therein. The disposing step can include the step of placing reinforcement material 42 within the mold 16.

In the operation of the invention, the vessel 12 is a water cooled pressure vessel with internal heating elements 22. The inner chamber 20 is a thin walled stainless steel pipe with a small metal tube 24 welded to the top through which gas may move. In the bottom of the inner chamber 20 is located a mold 16, such as graphite or stainless steel, which can be coated with a material to prevent reaction with molten magnesium (see U.S. Pat. No. 5,337,800). Contained within the mold 16 is ceramic reinforcement, such as silicon carbide whiskers. On top of the mold 16 is a filter 44 of alumina fibers. On top of the filter 44 is placed pieces of the low vapor point metal 18 to be cast. The tube 24 coming from the inner chamber 20 contains a filter 26 of carbon foam or other material, and a block 64 to prevent the filter 26 from being pulled out of the tube 24 during evacuation. The vessel 12 has insulation 72 and a water cooled port for cooling the vessel 12 and particularly the cooling section 34. A seal, such as an O-ring 74, may be used to seal the inner chamber 20 from the vessel 12.

During casting, the inner chamber 20 is heated by the heating elements 22 contained in the vessel 12 such that the mold 16 and any reinforcement 42 contained within and the metal 18 are heated within the inner chamber 20. During the heating operation, a vacuum is pulled through the tube 24. During heating, the vessel 12 may contain a low pressure gas such as nitrogen or standard atmosphere, or it may also have a vacuum, and this vacuum may be connected to the same vacuum being drawn through the tube 24 on the inner chamber 20. By connecting these two pressures together, any pressure differential is kept from existing on the inner chamber wall. Upon reaching the melting point of the metal 18, the liquid metal 18 seals off a vacuum inside the mold 16 and reinforcement 42. The low vapor point metal 18 does not deposit on the walls of the inner chamber 20 because the walls are heated to an equal or higher temperature than the metal itself. Once everything has reached the desired temperature, both the vessel 12 and inner chamber 20 are pressurized. This keeps a pressure differential from existing on the inner chamber wall and forces the liquid metal 18 into the mold 16 through the filter 44 and into any reinforcement 42 which may be contained in the mold 16. The resulting casting is cooled, preferably in a directional manner as described in U.S. Pat. No. 5,111,870 and U.S. Pat. No. 5,244,031, incorporated by reference. The inner chamber 20 is then removed from the vessel 12 and then the mold 16 and leftover metal 18 are removed from the inner chamber 20. This method may be used to cast net shape components or materials for extrusion or mixing into other materials.

In a specific casting example, magnesium is cast. A vacuum is pulled on the vessel 12 and mold 16 while the inner chamber 20 is heated by the heating elements 22 contained in the vessel 12. Once the magnesium 18 is heated to approximately 650° C. to 750° C., it melts and seals against the inner chamber wall, which isolates a vacuum inside the mold 16. The element 44 prevents the magnesium 18 from flowing into the mold 16. After the inner chamber 20 has reached the desired temperature, it is pressurized to 1000 psi through the tube 24. Pressurized gas flows into the vessel 12 and inner chamber 20 separately, though equally, resulting in a low differential between the inside and outside of the inner chamber wall. The gas, such as argon or nitrogen, forces the liquid magnesium 18 into the mold 16, and any reinforcement 42 contained within, while gas in the vessel 12 may be used to facilitate directional solidification by blowing gas directly on the bottom of the inner chamber 20 and mold as disclosed in U.S. Pat. No. 5,244,031. After pressurization, the casting is directionally solidified and cooled and the inner chamber 20 is then removed from the vessel 12. The casting can be net-shape. Alternatively, the casting can be an ingot which can be subsequently extruded.

In another embodiment, as shown in FIG. 3*b*, the mold 16 and metal 18 are contained in a separate container 58 inside the inner chamber 20. The metal 18 may be another low vapor point alloy such as a zinc or lithium alloy. The inner chamber 20 may be opened and closed and has a seal 59 of Grafoil® to prevent any vaporized metal 18 from escaping into the vessel 12. Pressure of 1,000 psi nitrogen is used to force the metal 18 into the mold 16 to produce the desired component.

It should be appreciated that the apparatus 10 allows for the control of the pressure applied on the mold wall by controlling the differential between the mold inner chamber and the interior 14 of the vessel 12. For example, a slightly greater pressure can be applied to the outside of the mold (within the vessel 12) to hold the mold 16 together and to keep it from leaking.

In this sense, the present invention is also an apparatus for casting material which comprises a vessel 12 having an interior 14 and a mold 16 disposed within the interior 14 of the vessel 12. The mold 16 has a mold chamber 15 which is fluidically isolated from the interior 14 of the vessel 12. There is a casting material 18 contained within the interior 14 of the vessel 12. The apparatus also comprises means 28 for independently applying vacuum and pressure to the interior 14 of the vessel 12 and the mold chamber 15 respectively to maintain a minimum pressure differential between the interior 14 of the vessel 12 and the mold chamber.

Further, the present invention is also a method for casting material 18 comprising the step of disposing a mold 16 within an interior 14 of a vessel 12. The mold 16 has a mold chamber 15 which is fluidically isolated from the interior 14 of the vessel 12. Then, there is the step of applying vacuum and pressure to the mold chamber 15 independent from application of vacuum and pressure to the interior 14 of the vessel 12 such that a minimal pressure differential is maintained during casting between the interior 14 of the vessel 12 and the mold chamber 15.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for casting low vapor point materials comprising:

a vessel having an interior;

a mold disposed within the interior of the vessel;

a casting material contained in the interior of the vessel; and means for providing the casting material to the mold in a manner such that vapors of the casting material are prevented from communicating with the interior of the vessel, said providing means in communication with said vessel.

2. An apparatus as described in claim 1 wherein the providing means comprises a container having an inner chamber within which the mold and casting material are contained, and means for heating the inner chamber, said heating means disposed within the interior of the vessel adjacent to the inner chamber.

3. An apparatus as described in claim 2 wherein the inner chamber has a tube extending therefrom having an element disposed therein for catching vapors of the casting material.

4. An apparatus as described in claim 3 wherein the tube extends through the vessel such that the interior of the vessel and the inside of the inner chamber are fluidically isolated.

5. An apparatus as described in claim 4 wherein the providing means includes means for pressurizing and evacuating the inner chamber through the tube.

6. An apparatus as described in claim 5 wherein the providing means comprises means for pressurizing and evacuating the vessel.

7. An apparatus as described in claim 6 wherein the vessel has a cooling section disposed adjacent to the tube for condensing any casting material vapors in the tube.

8. An apparatus as described in claim 7 wherein the vessel includes a cap forming a sealed cavity into which the tube of the inner chamber extends into, said inner chamber vacuum and pressurizing means connected to the cap in fluidic communication with the tube.

9. An apparatus as described in claim 8 wherein the inner chamber has the mold with reinforcement within and a filter between the mold and the casting material.

10. An apparatus as described in claim 9 wherein the inner chamber is comprised of a disposable container having welded ends.

11. An apparatus as described in claim 9 wherein the inner chamber is comprised of a permanent container having a removable and resealable end.

12. An apparatus as described in claim 11 wherein there is an inner container disposed within the inner chamber, said inner container having the mold and casting material.

13. An apparatus as described in claim 1 including means for directionally solidifying the material within the mold.

14. An apparatus as described in claim 13 wherein the directional solidification means comprises a gas chill line disposed adjacent to the inner chamber such that gas from the gas chill line is directed against the inner chamber, said gas chill line in fluidic communication with said means for pressurizing and evacuating the vessel.

15. An apparatus for casting material comprising:

a vessel having an interior;

a mold disposed within the interior of the vessel, said mold having a mold chamber which is fluidically isolated from the interior of the vessel;

a casting material contained within the interior of the vessel; and means for independently applying vacuum and pressure to the interior of the vessel and the mold chamber respectively to maintain a minimum pressure differential between the interior of the vessel and the mold chamber.

16. A method of casting low vapor point materials comprising the steps of:

disposing a container having an inner chamber, having a mold and casting material, within a vessel having an interior; and introducing the casting material into the mold in a manner such that vapors of the casting material are prevented from communicating with the interior of the vessel.

17. A method as described in claim 16 wherein before the introducing step, there is the step of heating the inner chamber with heating means disposed within the vessel such that the casting material is melted and stays melted as it is introduced into the mold.

18. A method as described in claim 17 wherein before the heating step, there is the step of evacuating the vessel and the inner chamber.

19. A method as described in claim 18 wherein the introducing step includes the step of pressurizing the vessel and the inner chamber such that the material is forced into the mold.

20. A method as described in claim 19 wherein the introducing step includes the step of directionally solidifying the material within the mold.

21. A method as described in claim 20 wherein the disposing step includes the step of orienting an element within a tube extending from the inner chamber such that the element traps any vapors of the casting material.

22. A method as described in claim 21 wherein the introducing step includes the step of cooling the tube to condense any vapors of the casting material.

23. A method as described in claim 22 wherein the disposing step includes the step of placing reinforcement material within the mold.

24. A method as described in claim 23 wherein the introducing step is such that a net shape part is created.

25. A method as described in claim 16 wherein the introducing step creates an ingot and after the introducing step, there are the steps of removing the ingot from the mold and extruding the ingot.

26. A method as described in claim 19 wherein the step of pressurizing the vessel and inner chamber includes the step of independently controlling pressure in the vessel and the inner chamber.

27. A method for casting material comprising the steps of:

disposing a mold within the interior of a vessel, said mold having a mold chamber which is fluidically isolated from the interior of the vessel; and applying vacuum and pressure to the mold chamber independent from application of pressure and vacuum to the interior of the vessel such that a minimal pressure differential is maintained during casting between the interior of the vessel and the mold chamber.

* * * * *